United States Patent [19]

Karp

[11] Patent Number: 4,642,605

[45] Date of Patent: Feb. 10, 1987

[54] POWER FAILURE RESPONSIVE WARNING DEVICE

[76] Inventor: S. Joel Karp, 1828 Boulevard, West Hartford, Conn. 06107

[21] Appl. No.: 835,176

[22] Filed: Mar. 3, 1986

[51] Int. Cl.[4] ..... G08B 5/24

[52] U.S. Cl. ..... 340/130; 40/539; 40/610; 40/612; 116/63 R; 340/120; 340/142; 340/815.29; 340/931

[58] Field of Search ..... 340/654, 663, 120, 130, 340/131, 142, 931, 815.29; 116/63 R, 63 P; 40/612, 359, 539, 584, 610; 281/2, 5; 283/34, 61, 62, 91, 99, 901; 434/305

[56] References Cited

U.S. PATENT DOCUMENTS

| | | | |
|---|---|---|---|
| 1,326,009 | 12/1919 | Wetter | 340/130 |
| 1,407,444 | 2/1922 | Smith et al. | 340/142 |
| 2,525,937 | 10/1950 | Palm | 283/34 |
| 3,863,214 | 1/1975 | Kerr, Jr. | 116/63 R X |
| 4,502,711 | 3/1985 | Muth | 281/5 |

*Primary Examiner*—James L. Rowland
*Assistant Examiner*—Daniel Myer
*Attorney, Agent, or Firm*—Prutzman, Kalb, Chilton & Alix

[57] ABSTRACT

A warning device is responsive to the failure of an electric power supply for activation to a warning mode. The warning device includes an arm pivotally mounted to a frame member and latched by an electromagnet in a non-warning mode. In the non-warning mode, a collapsible warning sign carrier is enclosed within an enclosure formed by the frame and the arm. When the supply of power is interrupted, the electromagnet releases the arm so that the arm pivots to a warning position.

19 Claims, 6 Drawing Figures

POWER FAILURE RESPONSIVE WARNING DEVICE

BACKGROUND OF THE INVENTION

This invention relates generally to visual signalling and particularly to the regulation of vehicular and/or pedestrian traffic under power failure conditions. More specifically, this invention is directed to a signalling device which operates in cooperation with an electrically controlled indicator, for example a traffic signal, for displaying a command signal upon the occurrence of a condition, power failure for example, to which the signalling device is responsive.

While not limited thereto in its utility, the present invention is particularly well suited for use in combination with conventional electrically powered traffic signals. It has long been recognized that public reliance on traffic signals can result in unfortunate consequences when the traffic signal is rendered inoperative due to an electrical power outage. The potential for a safety hazard is particularly acute at controlled relatively high-speed traffic intersections. A number of devices, operable in cooperation with a traffic signal, have been proposed for presenting a warning signal under certain conditions. Such prior warning devices are relatively complicated and difficult to install and may require extensive modification of the traffic signal.

In U.S. Pat. No. 3,863,214, entitled "Supplemental Visual Display for Traffic Signal", a visual display supplements a unidirectional traffic signal. During power disruption, the supplemental visual display indicates that the traffic signal is inoperative. The supplemental display includes an arm which supports a warning device at one end thereof. The arm is raised by an electric motor in response to an electric signal from the traffic signal controller. The arm is normally retained in an upright position by an electromagnet. In the event of a power outage, the electromagnet is released and the arm pivots to indicate that the traffic signal is inoperative. The arm is coupled to a shaft of a motor which returns the arm to the upright position when the power is restored.

The present invention is a power failure responsive warning device of modular form which does not require either an electric motor or a complex switching circuit and which may be easily mounted or fixed to a multi-directional traffic signal or the like.

SUMMARY OF THE INVENTION

Briefly stated, apparatus in accordance with the invention in a preferred form is a safety device which is responsive to the disruption of the supply of electricity at a given location for activating a warning signal. In the environment of a traffic control signal, the invention comprises a support frame adapted to be mounted to the housing of the traffic signal. An arm is mounted to the frame and is pivotal between a first generally upright or inoperative position, wherein the arm and the frame cooperate to form an enclosure, and a second or warning position wherein the arm projects away from the frame. A foldable indicia carrier is connected in fixed relationship to the frame and the arm and is extendable to form a readily apparent visual display. When the arm is in the first position, the foldable carrier is positioned entirely within the enclosure. When the arm is in the second position, the foldable carrier extends to make the display visible from a position remote from the device.

A latch retains the arm in the first position in response to the presence of electricity and releases the arm for pivotal movement to the extended or warning position in the absence of electricity at the given location.

The foldable carrier preferably comprises a plurality of strips which are interconnected to define a support having a generally corrugated configuration. The carrier is expandable and contractable relative to two generally orthogonally disposed axes. The display may comprise indicia affixed to the strips which forms the word "STOP".

In one reduction to practice of the invention, the arm had a metallic portion. In this embodiment the latch comprised a normally energized electromagnet which exerts a holding force for the metallic arm portion. A unique diverter is interposed in the power line of the traffic signal to direct electricity to the electromagnet and associated circuity for delaying release of the arm. Such a delay is desirable to prevent activation of the device in the case of momentary power failure.

An object of the invention is to provide a new and improved warning device which is responsive to the failure of an electric power supply for activation to a warning mode.

Another object of the invention is to provide a new and improved warning device which may be easily and efficiently mounted to existing control apparatus to provide a power failure responsive warning.

A further object of the invention is to provide a new and improved power failure responsive warning device of modular form which may be mounted on a multi-directional traffic signal and which does not require extensive modification of the traffic signal.

Other objects and advantages of the invention will become apparent from the specification and the drawing.

DETAILED DESCRIPTION OF THE INVENTION

Figure 3:
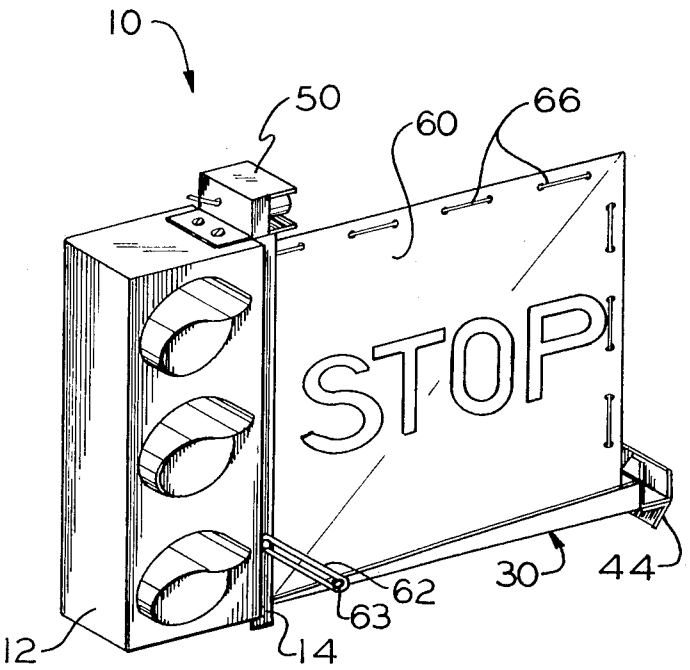
FIG. 3 is a perspective view of the warning device and traffic signal of FIG. 1 with the warning device being illustrated in the warning mode.

With reference to the drawing, wherein like numerals represent like parts throughout the figures, a warning device in accordance with the present invention is generally designated by the numeral 10. Warning device 10 has a modular form and in a preferred application is employed in association with a traffic signal 12. Traffic signal 12 may be a multi-directional signal of conventional form and function which derives the power necessary for operation from an alternating current source. The warning device 10 is responsive to the presence of electrical power at the traffic signal. In the event that the electrical power supply to the traffic signal is interrupted, the warning device 10 is actuated after a suitable time delay to a warning mode to present a visual traffic control signal such as illustrated in FIG. 3. Thus, in the event that the traffic signal becomes disabled due to a power outage, the warning device functions to provide a fail-safe traffic signal, a two-way stop for example, to thereby minimize the possibility that a power failure at the traffic signal will produce a safety hazard.

Figure 4:
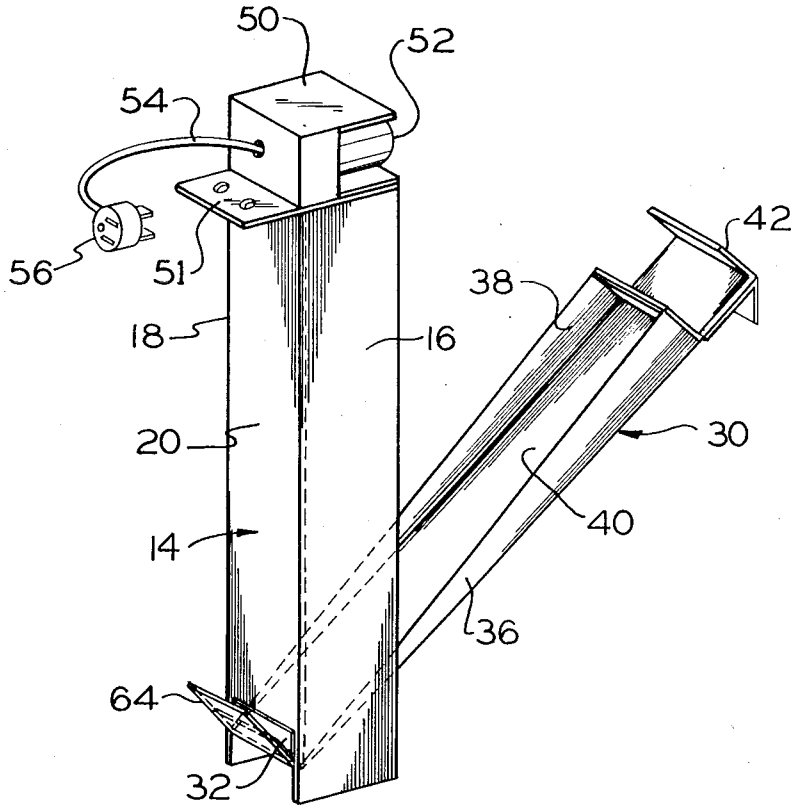
FIG. 4 is a fragmentary perspective view of the warning device of FIG. 1, portions of the warning device being illustrated in phantom and schematically, and portions being removed for purposes of illustrating the invention.

With reference to FIG. 4, an elongated support frame member, indicated generally at 14, functions as the principal structural support for the warning device 10. Frame member 14 is adapted for mounting to the traffic signal housing at one side thereof in a generally upright orientation. Frame member 14 generally spans the vertical extent of the signal housing and includes a pair of spaced generally parallel, vertically extending front and rear panels 16 and 18 which extend outwardly away from the signal. The front and rear panels may be formed by the bending of a strip of metal so that an intermediate rectangular side mounting panel 20 is formed between the front and rear panels. A plurality of openings (not illustrated) may be formed in panel 20 for receiving fasteners (not illustrated) to secure the warning device to the traffic signal housing. The front and rear panels preferably extend beyond the lower edge of the mounting panel 20 to form a pair of guide legs.

Figure 1:
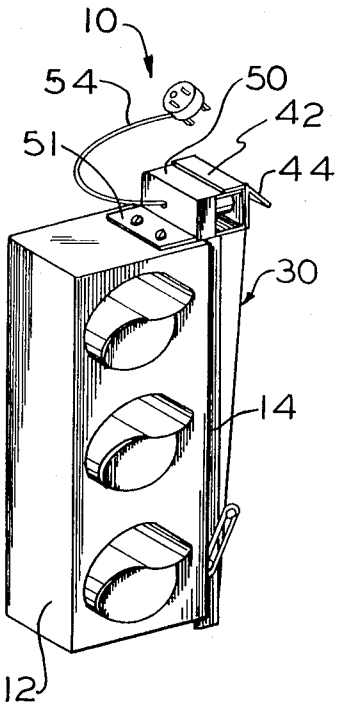
FIG. 1 is a perspective view of a warning device in accordance with the present invention illustrated in the non-warning mode in conjunction with a traffic signal.

Warning device 10 also includes a signal arm which has been indicated generally at 30. One end of arm 30 is received between the extension of panels 16 and 18 of frame member 14. Arm 30 is pivotally mounted to the lower end of mounting panel 20. In the disclosed embodiment of the invention a hinge 32 is secured to the respective lower ends of the mounting panel 20 and the signal arm 30 to provide the pivotal connection. The signal arm 30 is preferably formed from a metal sheet which is bent to form spaced front and rear sides 36 and 38 and cover member 40 which extends therebetween. Cover member 40 has a generally rectangular shape and a width which is preferably commensurate with the width of the mounting panel 20. Front side 36 generally aligns with front panel 16, and rear side 38 generally aligns with rear panel 18 of frame member 14 so that when the signal arm 30 is upwardly pivoted into engagement with frame member 14, as illustrated in FIG. 1, the frame member and signal arm cooperate to form an enclosure.

The front side 36 and the rear side 38 of arm 30 preferably have identical tapered shapes which gradually increase in width from the pivot end of the signal arm to the free end of the arm. Because of the tapered side configuration, the free end of arm 30 has a greater weight than the pivotal end of the arm. The center of gravity of the signal arm is thus located at a position spaced outwardly, i.e., away from the mounting panel 20, with respect to a vertical plane which passes through the pivot axis of hinge 32. A plate 42 extends from cover member 40 and projects toward the top of the frame member 14 at the free end of the signal arm. A reset plate 44, see FIG. 3, which may be slightly angled projects outwardly from cover member 40 adjacent the free end of arm 30.

A two compartment actuator/latch housing 50 is mounted at the top of frame 14. In the disclosed embodiment the compartment of housing 50 which is located adjacent to arm 30 encloses an electromagnet 52 while the other compartment houses the delay circuitry of the warning device. Housing 50 is dimensioned and positioned so that plate 42 lightly engages the top of the housing when the device is in the stored mode illustrated in FIG. 1. A mounting bracket 51 transversely projects from housing 50 for fastening the device to the top of the traffic signal. An electrical cord 54 extends through housing 50 to provide power to the delay circuit and to electromagnet 52. In actual practice, the housing 50 will be closed at the sides of electromagnet 52.

The relative positioning and construction of electromagnet 52 and arm 30 is such that they form part of the same magnetic circuit with the arm in the raised (stored) position. Energization of electromagnet 52 will produce a field of sufficient strength to hold arm 30 in place in the stored position illustrated in FIG. 1, the size of the electromagnet employed being chosen as a function of the weight and balance of arm 30.

Figure 5:
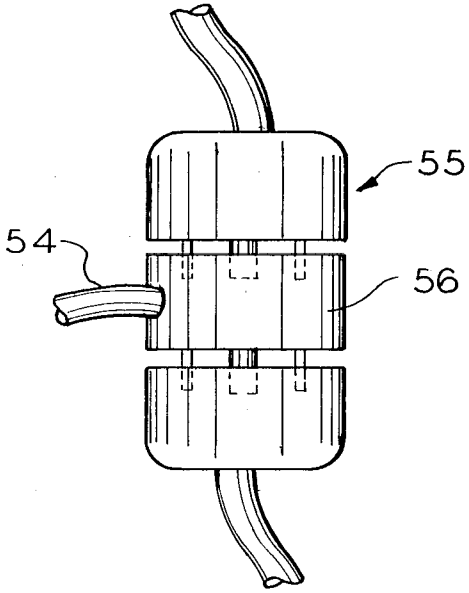
FIG. 5 is an enlarged fragmentary view of an electrical connection employed with the warning device and traffic signal of FIG. 1.
Figure 6:
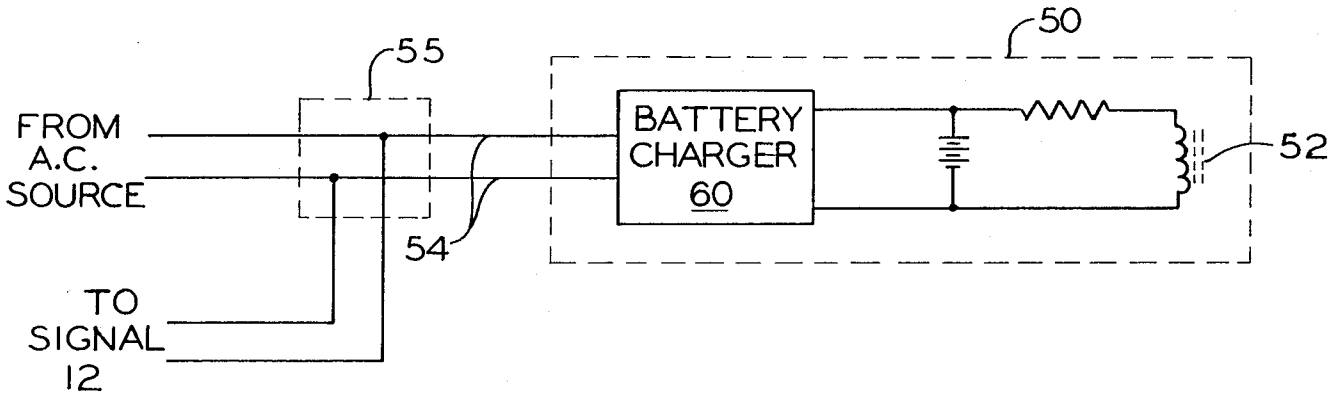
FIG. 6 is a functional circuit diagram of the warning device of FIG. 1.

An adaptor 56 such as illustrated in FIG. 5 and shown schematically in FIG. 6 is provided for insertion in the power line connection 55 to the traffic signal to divert energizing current to electromagnet 52. Adaptor 56 allows installation and removal of device 10 without electrical modification of traffic signal 12. Adaptor 56 may actually be located within the housing of signal 12.

Figure 2:
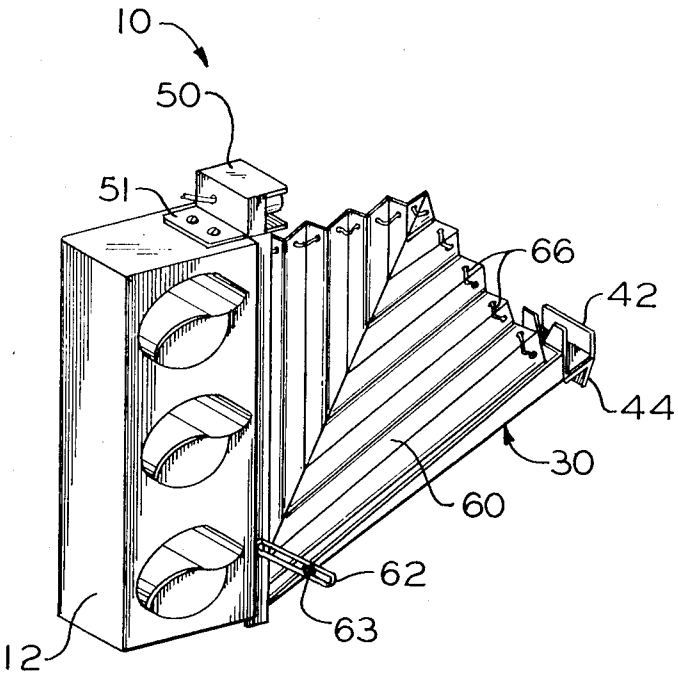
FIG. 2 is a perspective view of the warning device and traffic signal of FIG. 1 with the warning device being illustrated in a transitional mode.

With reference to FIG. 2, a panel 60 having a plurality of accordian-like folds, which form an orthogonal pair of generally triangular shaped collapsible sections, extends between frame member 14 and signal arm 30. In one form of the invention, the outermost member of the upper section of panel 60 is affixed to mounting panel 20, and the outermost member of the other section of panel 60 is affixed to cover member 40. Panel 60 may be formed from plexiglass, mylar, plastic, aluminum or some other suitable metal. The panel material may be coated with or comprised of a fluorescent material or may support reflective tape. Adjacent edges of the members which comprise the panel 60 are interconnected by flexible material which functions as a hinge and, depending on the material from which the panel is formed, the hinges may be integral with the panel material. Panel 60 is configured so that when the signal arm 30 is pivoted to the stored position of FIG. 1 the panel is collapsed to fit within the enclosure formed by the cooperating sides and panels of the frame member and the signal arm. Slots or other holes (not illustrated) will usually be formed in the panel 60 to reduce the adverse effects of wind impinging against the extended panel.

With reference to FIG. 3, both sides of the panel 60 are provided with indicia such as the word "STOP". It should be appreciated that when power to the traffic signal is disrupted, the electromagnet 52 will be deenergized and the signal arm 30 will fall to the warning position illustrated in FIG. 3. The signal arm 30 falls due to the offset center of gravity. In the disclosed embodiment, a supplemental impetus is not required to move the signal arm 30 to the warning position. Thus, a fail-safe traffic control signal is provided in the event that the power to the primary traffic signal fails. In the illustrated embodiment, one set of opposing lanes of traffic will automatically be presented with a "STOP" sign. Naturally, other safety and traffic signals could be employed. Because of the tapered side configuration of the signal arm, the top-heavy, offset center of gravity in the FIG. 1 non-warning orientation will cause the signal arm to pivotally fall under its own weight. A spring-type mechanism (not illustrated) could also be employed to insure the pivotal drop of the signal arm.

A slotted bracket 62 may be employed in combination with a pin 63 fixed to the signal arm to provide a stop to limit the downward pivotal movement of the signal arm as illustrated in FIGS. 1 through 3. An L-shaped plate 64 may also or alternatively be mounted on the signal arm for engagement with the mounting panel 20 to provide a stop for the signal arm. In addition, a plurality of openings may be formed adjacent the periphery of the members of the signal panel 60. A shock cord 66 may be threaded through these openings and secured to the top of frame member 14 and the free end of the signal arm 30 to reduce the stress on the panels due to the weight of the falling signal arm 30 and to minimize the possibility of damage as a result of wind gusts.

A time delay circuit is included in housing 50 to insure that a momentary power failure does not result in the unlatching of arm 30. The time delay circuit may, for example, take the form illustrated schematically in FIG. 6. Thus, the delay circuit may comprise a battery charger 60 which supplies holding current for electromagnet 52 and maintains a battery 62 in a fully charged state. Upon occurrence of a power failure, the holding current will be supplied by battery 62 for a period of time determined by the size of the battery and the circuit resistance, discharging of the battery resulting in the holding current falling below the level required to generate a field of sufficient strength to support arm 30. It is to be understood that alternative delay circuits may be utilized.

Reset plate 44 permits the warning device to be easily reset to the stored position of FIG. 1 after power has been restored to the traffic signal and hence to the electromagnet. A pole (not illustrated) may be employed to engage reset plate 44 for pivotally displacing the signal arm 30 to the upright latched position.

While a preferred embodiment of the foregoing invention is set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A warning device responsive to an electrical power interruption at a given location to activate a warning signal comprising:

elongated support means adapted to be mounted for disposition in a generally upright orientation;

elongated arm means pivotally mounted at a first end thereof to said support means, said arm means being pivotal between a first generally upright position wherein said support means and arm means are generally parallelly oriented and cooperate to form an enclosure and a second warning position wherein said arm means projects away from said support means to open the said enclosure;

flexible carrier means having first and second edge portions, said first edge portion being connected in fixed relationship to said support means and said second edge portion being connected in fixed relationship to said arm means, said carrier means being substantially entirely enclosed in said enclosure when said arm means is in the first position, said carrier means being extended to define a support for a visual display when said arm means is in said second position; and latch means for holding said arm means in said first position in response to the presence of electricity at a given location, said latch means being responsive to interruption of the supply of electrical power to said given location to release said arm means for pivotal movement to the second warning position.

2. The warning device of claim 1 wherein said flexible carrier means comprises a plurality of flexibly connected elongated strips which cooperate to define a corrugated display support which is expandable and contractable relative to two generally orthogonally disposed axes.

3. The warning device of claim 2 wherein said display support includes a pair of generally triangular shaped sections with the strips within the two sections respectively being oriented in a pair of transverse directions.

4. The warning device of claim 1 wherein said arm means is at least partly comprised of a ferromagnetic material and said latch means comprises an electromagnet which is energizable to exert a magnetic force of attraction for said ferromagnetic material.

5. The warning device of claim 1 wherein said support means comprises an elongated frame member, said device further comprises a housing mounted to one end of said frame member and said latch means comprises an electromagnet mounted in said housing.

6. The warning device of claim 1 wherein said arm means has a pivot end and a latch end and comprises a pair of side panels which are tapered from said pivot end to said latch end.

7. The warning device of claim 1 further comprising:

means for delaying the release of said arm means by said latch means upon interruption of the supply of electrical power.

8. The warning device of claim 1 further comprising stop means to limit the pivotal movement of said arm means to said second warning position.

9. The warning device of claim 8 wherein said flexible carrier means comprises a plurality of flexibly connected elongated strips which cooperate to define a corrugated display support which is expandable and contractable relative to two generally orthogonally disposed axes.

10. The warning device of claim 9 wherein said display support includes a pair of generally triangular shaped sections with the strips within the two sections respectively being oriented in a pair of transverse directions.

11. The warning device of claim 10 wherein said arm means is at least partly comprised of a ferromagnetic material and said latch means comprises an electromagnet which is energizable to exert a magnetic force of attraction for said ferromagnetic material.

12. The warning device of claim 11 further comprising:

a housing mounted on said support means, said electromagnet being positioned within said housing.

13. The warning device of claim 10 wherein said arm means has a pivot end and a latch end and comprises a pair of side panels which are tapered from said pivot end to said latch end.

14. The warning device of claim 13 further comprising:

means for delaying the release of said arm means by said latch means upon interruption of the supply of electrical power.

15. The warning device of claim 13 wherein said arm means is at least partly comprised of a ferromagnetic material and said latch means comprises an electromagnet which is energizable to exert a magnetic force of attraction for said ferromagnetic material.

16. The warning device of claim 15 further comprising:

means for delaying the release of said arm means by said latch means upon interruption of the supply of electrical power.

17. The warning device of claim 16 wherein said sections are right triangles which are interconnected at their hypotenuses.

18. The warning device of claim 17 further comprising a housing mounted on said support means, said electromagnet and said delaying means being positioned in said housing.

19. In combination:

an electrically operated traffic signal having a housing and an electrical supply line for the delivery of electrical power to said signal;

a frame mounted to said housing for disposition in a generally upright orientation;

an arm pivotally mounted to said frame, said arm being pivotal between a first generally upright position wherein said frame and arm cooperate to form an enclosure and a second warning position wherein said arm projects away from said frame;

flexible carrier means having first and second edge portions and a visually observable warning indicator, said first edge portion being connected in fixed relationship with said frame and said second edge portion being connected in fixed relationship with said arm so that when the arm is in the first position said carrier means is substantially enclosed in said enclosure and when said arm is in the second warning position said warning indicator is visible;

latch means comprising an electromagnet for retaining said arm in said first position upon electrical energization of said electromagnet and for releasing said arm for pivotal movement to the warning position in the absence of electrical energization;

diverter means interposed in said traffic signal electrical supply line for directing current to said electromagnet; and means for delaying the release of said arm by said latch means upon interruption of the supply of electrical power to said traffic signal.

* * * * *